US009458519B2

(12) United States Patent
Goldsteinas et al.

(10) Patent No.: US 9,458,519 B2
(45) Date of Patent: Oct. 4, 2016

(54) PROCESS FOR COOLING A METAL WORKLOAD IN A MULTIMEDIA QUENCH SYSTEM

(71) Applicant: IPSEN, INC., Cherry Valley, IL (US)

(72) Inventors: Aymeric Goldsteinas, Machesney Park, IL (US); Werner Hendrik Grobler, Clyde Park, MT (US)

(73) Assignee: IPSEN, INC., Cherry Valley, IL (US)

( * ) Notice: Subject to any disclaimer, the term of this patent is extended or adjusted under 35 U.S.C. 154(b) by 301 days.

(21) Appl. No.: 14/023,810

(22) Filed: Sep. 11, 2013

(65) Prior Publication Data

US 2014/0090754 A1 Apr. 3, 2014

Related U.S. Application Data

(60) Provisional application No. 61/707,596, filed on Sep. 28, 2012.

(51) Int. Cl.

| | |
|---|---|
| ***C21D 1/667*** | (2006.01) |
| ***C21D 1/62*** | (2006.01) |
| ***C21D 1/70*** | (2006.01) |
| ***C21D 1/18*** | (2006.01) |
| ***C21D 11/00*** | (2006.01) |
| ***C21D 1/58*** | (2006.01) |

(52) U.S. Cl.

CPC . *C21D 1/18* (2013.01); *C21D 1/58* (2013.01); *C21D 1/62* (2013.01); *C21D 1/63* (2013.01); *C21D 1/64* (2013.01); *C21D 1/70* (2013.01); *C21D 11/005* (2013.01)

(58) Field of Classification Search

None

See application file for complete search history.

(56) References Cited

U.S. PATENT DOCUMENTS

| | | | |
|---|---|---|---|
| 5,868,871 | A | 2/1999 | Yokose et al. |
| 6,120,613 | A | 9/2000 | Romack et al. |

(Continued)

FOREIGN PATENT DOCUMENTS

| | | | |
|---|---|---|---|
| DE | 10 2005 015 450 | | 8/2006 |
| DE | 102005015450 | * | 8/2006 |

(Continued)

OTHER PUBLICATIONS

Machine-English translation of Japanese patent 11153386A, Katsumata Kazuhiko, Jun. 8, 1999.*

(Continued)

*Primary Examiner* — Deborah Yee

(74) *Attorney, Agent, or Firm* — Dann, Dorfman, Herrell and Skillman, P.C.

(57) ABSTRACT

A process and apparatus for quenching a metal workload from an elevated heat treating temperature are disclosed. The process includes the step of flowing a vegetable oil quenchant over the metal workload to provide a cooling rate sufficient to transform the metal substantially completely to a desired second phase comprising martensite, bainite, pearlite, or a combination thereof within a preselected time period. The apparatus includes a quenching chamber that has a base, an upper housing, a door, and an associated actuator for opening and closing the quenching chamber. The apparatus also includes a vessel for holding a volume of a vegetable oil quenchant, means for conducting the vegetable oil quenchant from the vessel to the quenching chamber, and means disposed in the quenching chamber for flowing the vegetable oil quenchant over a metal workload disposed in the quenching chamber.

11 Claims, 5 Drawing Sheets

(56) References Cited

U.S. PATENT DOCUMENTS

| | | | | |
|---|---|---|---|---|
| 6,312,509 | B1 | 11/2001 | Moradian | |
| 6,402,857 | B2 * | 6/2002 | Clark | C11D 7/24 134/11 |
| 2003/0113186 | A1 | 6/2003 | Hiramoto | |
| 2012/0247627 | A1 | 10/2012 | Grobler et al. | |
| 2013/0177860 | A1 | 7/2013 | Hamid et al. | |

FOREIGN PATENT DOCUMENTS

| | | | |
|---|---|---|---|
| DE | 102007048041 | | 4/2009 |
| EP | 0621344 | | 10/1994 |
| FR | 2379607 | | 9/1978 |
| JP | 29-5389 | | 8/1954 |
| JP | 58-11726 | | 1/1983 |
| JP | 4-180517 | | 6/1992 |
| JP | 5-171481 | | 7/1993 |
| JP | 11-153386 | | 6/1999 |
| JP | 11153386 | A * | 6/1999 |
| JP | 2001-316722 | | 11/2001 |
| WO | 2004099450 | | 11/2004 |

OTHER PUBLICATIONS

B. Liscic, Controllable heat extraction technology—what it is and what it does, Int., J. Material and Product Technology, vol. 24, Nos. 1-5, pp. 170-183., 2005.*

Machine-English translation of Japanese patent 05-171481A to Ogawa Teiji, Jul. 9, 1993.*

Machine-English translation of Japanese patent 2001-316722, Nakamura Hidekazu, Nov. 16, 2001.*

Ester Carvalho De Souza et al., "Heat Transfer Properties of a Series of Oxidized and Unoxidized Vegetable Oils in Comparison with Petroleum Oil-Based Quenchants," Proceedings of the 26th ASM Heat Treating Society Conference, Copyright 2011 ASM International, pp. 235-243.

Diego Said et al., "Effect of the Oxidation Stability of Soybean Oil and Palm Oil on Steel Quenching Performance," Proceedings of the 26th ASM Heat Treating Society Conference, Copyright 2011, ASM International., pp. 258-265.

Ester Carvalho De Souza et al., "Quenchants Derived from Vegetable Oils as Alternatives to Petroleum Oil," www.industrialheating.com, posted Aug. 31, 2011, pp. 1-6.

K. Narayan Prabhu et al., Metal/Quenchant Interfacial Heat Flux Transients During Quenching in Conventional Quench Media and Vegetable Oils, J. of Materials Engineering and Performance, vol. 12, No. 1., Feb. 2003, pp. 48-55.

Robert J. Brennan et al., A Quenchant Based on Canola Oil, Advanced Materials & Processes, vol. 152, No. 2, Aug. 1997, pp. 32S-32U.

EP Appln No. 13004630, European Search Report, Dec. 4, 2013, 4 pages.

English Translation of Official Action; JP Appln. No. 2013-201063; Sep. 15, 2015.

* cited by examiner

PROCESS FOR COOLING A METAL WORKLOAD IN A MULTIMEDIA QUENCH SYSTEM

CROSS-REFERENCE TO RELATED APPLICATION

This application claims the benefit of U.S. Provisional Application No. 61/707,596, filed Sep. 28, 2012, the entirety of which is incorporated herein by reference.

BACKGROUND OF THE INVENTION

1. Field of the Invention

The invention relates to a quenching process for heat treated metal parts, and in particular to a system and process for quenching and cleaning such metal parts with biodegradable media.

2. Description of the Related Art

Many steel alloys are hardened and strengthened by heating and then rapidly cooling the alloy. In a typical heat treating process the alloy is heated to a temperature above the upper critical temperature ($Ac_3$), which is dependent on the composition of the alloy, so the metal is completely in the austenite phase. The alloy is then rapidly cooled by a quenching liquid or gas (quenchant) so that it can be converted into the harder martensite phase. A sufficiently fast cooling rate is needed to minimize the formation of other phases such as bainite and pearlite which are softer than martensite and will adversely affect the physical properties required of the steel. However, the cooling rate can be controlled so that various combinations of phases can be present in the as-quenched metal.

The key to successfully accomplishing this process is the uniform removal of heat from the surface of the metal part. Continuous cooling curves showing the cooling rates for a ferrous alloy are shown in FIG. 1. The first curve (1) is designed to provide a combination of martensite and austenite in the as-quenched metal. The second curve (2) is designed to provide a fully martensitic structure in the as-quenched metal. The third curve (3) is designed to provide a combination of martensite and bainite and the fourth curve (4) is designed to provide a combination of martensite and pearlite in the as-quenched metal.

In industrial practice a number of different quenchants are used, of which the main quenchants are water, quenching oils, aqueous polymer solutions, molten salts, and high pressure inert gas.

1. Quenching in Liquid

Quenching in a liquid typically includes three stages which are illustrated in FIG. 2. These stages of liquid quenching may not occur at all points on a part at the same time.

In the first stage, vapor blanket or film boiling occurs where a thin film of vaporized liquid forms in close proximity to the surface of the metal and prevents the liquid from coming into contact with the surface to thereby cool the metal surface. This stage is characterized by a low convective heat transfer.

In a second stage nucleate boiling occurs wherein the liquid vaporizes at the surface of the metal part with a very high heat exchange. The boiling point of the quenchant determines the end of this stage.

In the third stage, convection occurs wherein the liquid is close to the metal surface and the transfer of heat occurs through convection.

A. Water Quenching

Of the four liquids used for quenching, pure water is hardly ever used because of its stable vapor phase which produces non-uniform heat extraction. The addition of one or more salts to the water speeds up the breakdown of the vapor phase, thereby increasing the quenching intensity of the water. This effect results in very rapid cooling rates at the surface of the metal components, but produces large stress gradients with a danger of cracking of the components during quenching.

B. Atmosphere Oil Quench

Quenching oils of different qualities exist with the quenching severity depending on their composition and physical properties, the most important property being the viscosity of the oil. Oil, just as water, exhibits a pronounced vapor phase followed by a nucleate boiling phase with a very rapid heat transfer in the temperature range 600° C. to 300° C. typically encountered during oil quenching.

During the nucleate boiling stage of oil quenching, extremely high instantaneous heat transfer coefficients can be achieved. This is a distinct advantage in the temperature range where pearlitic transformation occurs and one not available by gas quenching. With the breakdown of the vapor phase at the onset of boiling, however, the so-called Leidenfrost phenomenon occurs. The result is a nonuniform heat transfer rate on different surfaces of the metal parts which is dependent on a variety of variables and factors. This uneven transitory step creates large temperature differentials and is a major factor in part distortion when quenching in oil media.

C. Molten Salt

Another known quenching medium is molten salt. A molten salt bath quench does not have a vapor stage or a boiling stage. Therefore, like a gas quench, molten salt quenching provides a purely convective heat transfer with the highest heat transfer right at the start of the immersion of the components into the molten salt.

Because the salts have to be molten in order to be used, their application temperature is by nature higher than those of water and oil. They are normally used in the range about 140° C. to about 350° C. This higher application temperature has the positive effect of reducing the quenching severity in the lower temperature range where martensitic transformation takes place. This is also beneficial for uniform stress distribution which results in very low distortion of the hardened metal components.

D. Disadvantages of the Known Liquid Quenching Techniques

During the nucleate boiling stage of liquid quenching such as with water, polymer, or oil, extremely high instantaneous heat transfer coefficients can be achieved. This is a distinct advantage in the temperature range where pearlitic transformation occurs and one not possessed by gas quenching. With the breakdown of the vapor phase at the onset of boiling, however, the so-called Leidenfrost phenomenon occurs as discussed above. Moreover, petroleum-based oils and salt baths are not readily disposable because of their toxic nature. Therefore, the use of such quenching media presents environmental concerns that increase the cost of their use.

II. Gas Quenching

Forced gas quenching is a single-stage quenching of a purely convective type. Gas type, gas pressure, and gas velocity are the main control parameters. Typically, a gas quenching chamber is equipped with a powerful fan and is adapted for injecting a cooling gas at a positive pressure of up to 20 bar. The gas quenching chamber may include one or more heat-exchangers using chilled water to quickly remove heat from the quenching gas. The most common quenching gas medium is nitrogen gas. However, other gases are also used such as argon gas, helium gas, hydrogen gas, and mixtures thereof.

Quenching with high pressure gas is preferable for high hardenability alloys. Typical grades of steels for which forced gas quenching is suitable include AISI-SAE grades 8620, 5120, and 4118, 17CrNiMo6, SAE grades 9310, 3310, 8822H, 4822, and 8630. However, lower hardenability, plain carbon steels that can be carburized and oil quenched, simply cannot be hardened using a gas quench because they will not properly transform under the slower cooling rates of gas quenching. Even with high hardenability grades some consideration must be given to core hardness, because the gas quench will produce lower core hardness compared to oil quenched parts.

A major advantage of quenching under high pressure inert gas is that these same slow cooling rates translate into low distortion from quenching. Many parts that cannot be successfully oil quenched and maintain required dimensional tolerances can be High Pressure Gas Quench (HPGQ) processed and provide acceptable dimensions in the as-quenched condition.

By eliminating the non-uniform cooling of parts associated with liquid quenches that have vapor, boiling, and convective cooling all taking place simultaneously and replacing it with gas quenches that have slower cooling rates and are more uniform and purely convective, distortion can be greatly reduced because the surfaces are more uniformly cooled at slower rates. HPGQ can sometimes eliminate post-heat treatment straightening or clamp tempering operations, reduce grind stock allowances and hard machining, or replace more costly processes such as press quenching When properly applied, gas quenching has several recognized advantages, which include safety, overall economics, reduction of secondary manufacturing operations, minimizing of dimensional variation, controllable cooling rates, part cleanliness, and overall environmental impact.

There are also disadvantages that must be considered when using HPGQ technology. These include cooling rate limitations (i.e., quench severity), reversed application of heat transfer rates (i.e., slow cooling rates in the pearlitic transformation range and high cooling rates in the martensitic transformation range), regulations and codes for the pressure vessel, and high noise levels.

III. Comparison of Quench Rates

For oil quenching, the peak of the oil cooling rate in the boiling phase is 80° C./s and takes place in the important phase of steel quenching to avoid ferrite or pearlite formation.

For gas quenching, the limited quenching speed at high temperature (pearlite transformation) and high rate at low temperature (martensite transformation).

During gas quenching, one heat transfer phenomenon is usually encountered: convection. This results in a lower heat transfer coefficient than in the case of a vaporizable liquid like oil, but in a more homogeneous cooling as all the part is approximately cooled at the same rate at a same time. It leads also to a lower distortion level of the parts.

BRIEF SUMMARY OF THE INVENTION

In accordance with a first aspect of the present invention, there is provided a process for cooling a metal workload that has been heated to an elevated temperature. The process includes the steps of providing a metal workload that has been heated to an elevated temperature selected to transform the metal part substantially completely into an austenitic phase and placing the metal workload in a quenching chamber while the metal part is at the elevated temperature. The process also includes the step of closing the quenching chamber after the metal workload is in the quenching chamber. When the metal workload is closed inside the quenching chamber, the process continues with the step of flowing a vegetable oil quenchant over the metal workload to provide a cooling rate sufficient to transform the metal substantially completely to a desired second phase comprising martensite, bainite, pearlite, or a combination thereof within a preselected time period.

In accordance with a second aspect of the present invention, there is provided a quenching apparatus for cooling a heat treated metal part. The quenching apparatus includes a base having means for supporting a heat treated metal part. The base is closed at a lower end thereof and is open at an upper end thereof. The quenching apparatus includes an upper housing having a portion that is open at a lower end thereof and a domed portion formed at an upper end of the upper housing. The quenching apparatus also includes a means for supporting the upper housing above the base in spaced vertical coaxial relation such that an opening is defined between the base and the upper housing. A door that is dimensioned and arranged to be coaxial with the upper housing and the base is included for closing the quenching apparatus. An actuator is coupled to the door for moving the door between an open position inside the upper housing and a closed position wherein the door extends between the upper housing and the base for closing the opening to thereby provide a quenching chamber. The quenching apparatus further includes a vessel that is separate from the quenching chamber and is arranged for holding a volume of vegetable oil quenchant. The quenching apparatus according to this invention further includes means for conducting the vegetable oil quenchant from the vessel to the quenching chamber and means disposed in the quenching chamber for flowing the vegetable oil quenchant into the quenching chamber and over a metal workload disposed in the quenching chamber.

BRIEF DESCRIPTION OF THE DRAWINGS

The foregoing background of the invention and the following detailed description will be better understood when read with reference to the drawings wherein.

DETAILED DESCRIPTION

Figure 1:
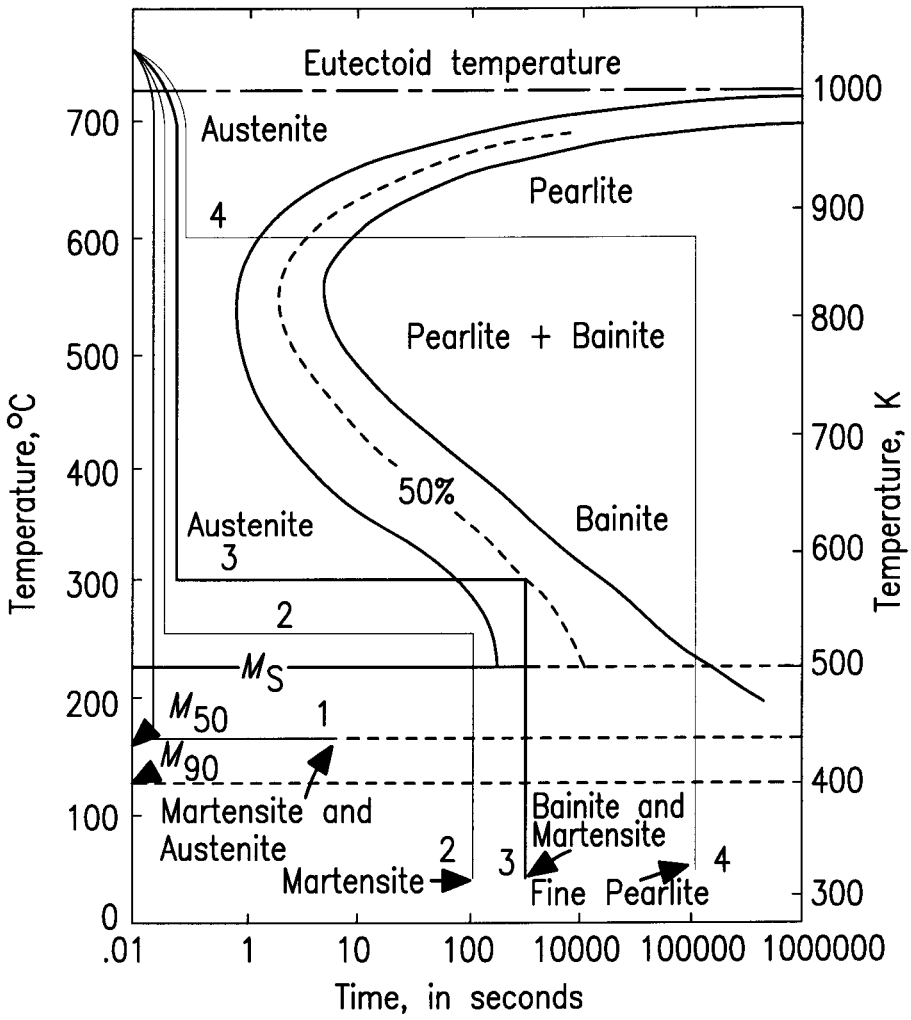
FIG. 1 PRIOR ART
FIG. 1 is a graph of known continuous cooling curves for a known ferrous alloy.
Figure 2:
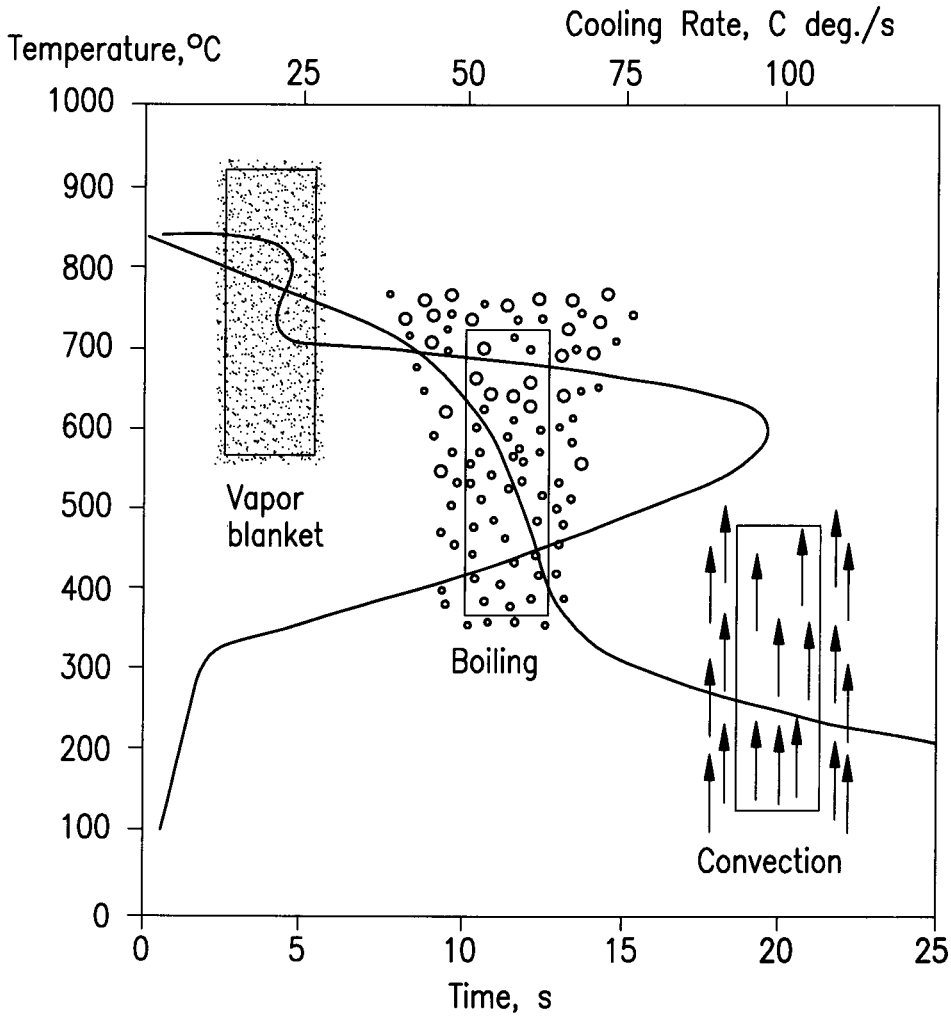
FIG. 2 PRIOR ART
FIG. 2 shows typical graphs of a cooling curve and a cooling rate curve with the three stages of cooling encountered during a known oil quenching process.
Figure 3:
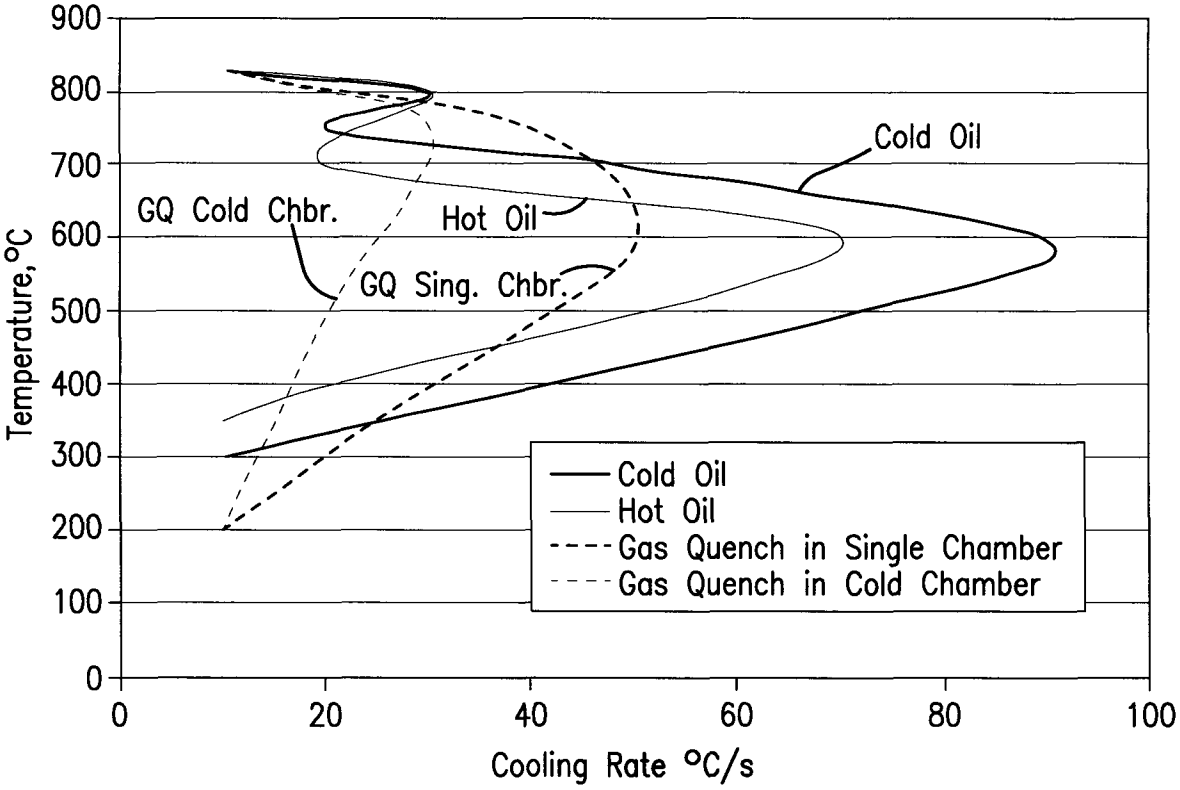
FIG. 3 PRIOR ART
FIG. 3 shows a comparison of typical cooling rate curves for oil quenching and gas quenching processes.
Figure 4:
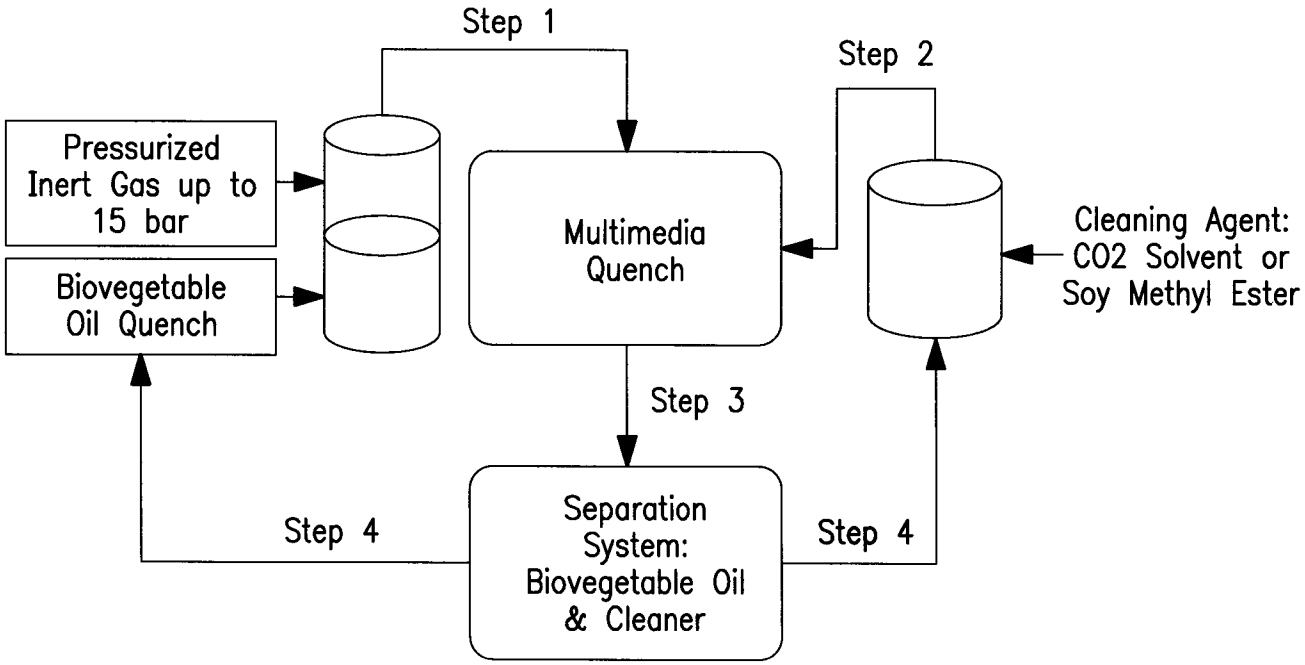
FIG. 4 is a schematic diagram of a quenching process in accordance with the present invention.

Referring now to FIG. 4, there is shown an embodiment of the multimedia quenching process according to the present invention. The quenching process of this invention is designed for use on a steel work piece or a batch of such work pieces, (hereinafter, the workload) that has been heated to an elevated temperature at which the steel material transforms to a desired phase, typically austenite. The workload is preferably heated to a temperature of about 1400° F.-2400° F. for this purpose. The workload is preferably heated for a time duration selected to provide substantially full transformation to the austenitic phase. The time at temperature depends on the alloy composition and the cross-sectional dimensions of the workload. The heating step is conducted with the steel workload in a heating chamber that is connected to a quenching chamber. When the steel workload has been heated for the requisite period of time, the workload is transferred from the heating chamber to the quenching chamber.

In the process according to the present invention, a quenchant comprising a vegetable oil is used. A preferred vegetable oil quenchant is soybean oil. However, other vegetable-type oils such as cottonseed oil, canola oil, palm oil, sunflower seed oil, corn oil, and mixtures thereof with or without soybean oil may also be used. During the heating of the workload, the vegetable oil quenchant is heated in a separate reservoir that is connected to the quenching chamber. The vegetable oil quenchant is preferably heated to a temperature of about 70° F.-1000° F. depending on the nature of the alloy to be quenched. In another embodiment of the process of this invention the pressure inside the oil reservoir is raised to a desired level, preferably about 1 to 15 bar, by pumping in an inert gas such as nitrogen gas or argon gas.

When the workload has been transferred to the quenching chamber, the quenching chamber is closed and sealed. The vegetable oil quenchant is then allowed to flow from the reservoir into the quenching chamber. Preferably, this occurs by creating a pressure differential between the vegetable oil reservoir and the quenching chamber. The quenching chamber is adapted with piping and nozzles above and adjacent to the workload so that the vegetable oil quenchant floods or sprays over the workload and collects in the bottom of the quenching chamber. As the vegetable oil quenchant collects in the bottom of the quenching chamber, it is recirculated by a pump that draws the vegetable oil quenchant from the bottom of the quenching chamber and forces it through the piping and nozzles.

The quenching step is preferably performed with the quenching chamber under a subatmospheric pressure or vacuum. In a preferred embodiment, the quenching step is performed at subatmospheric pressure of about 500 torr to about 100 torr. The use of a subatmospheric pressure during the quenching step provides at least the following advantages. The use of subatmospheric pressure during the quenching step prevents the vegetable oil from oxidizing. Oxidation of the oil adversely affects its cooling performance and results in darkening of the metal surfaces of the work load. Also, the use of a subatmospheric pressure alters the boiling point of the oil which will change the cooling characteristic of the oil. Lowering the pressure in the quenching chamber extends the vapor blanket stage and the boiling stage of the cooling curve. The use of vacuum during the quenching step permits tailoring (optimization) of the quenching process. For example, the vegetable oil quench under vacuum provides a high initial quenching speed in the critical hardening range to avoid the ferritic and pearlitic transformation regions, and also provides a slower final quenching speed in the martensitic region. The higher initial cooling rate allows for the development of full hardness by reaching the martensite transformation start temperature ($M_s$) quickly enough to avoid the formation of other metallurgical phases such as bainite, pearlite, and ferrite. Whereas cooling at a slower rate when the martensite transformation temperature is reached provides better stress equalization which reduces distortion and/or cracking of the steel workpiece.

In another preferred embodiment of the process of this invention, an inert gas such as nitrogen gas is applied to the quenching chamber. The inert gas blanket also helps to inhibit oxidation of the vegetable oil quenchant. In this embodiment the inert gas is used at a pressure of up to 15 bar in the quenching chamber. The inert gas pressure may be constant through the quenching step. In a preferred embodiment of the quenching process according to this invention, the gas pressure is varied during the quenching cycle to provide different cooling rates at different stages in the quenching cycle. Variation of the inert gas pressure provides control of the cooling rate during the quenching step. A lower pressure will reduce the boiling point and thus, the cooling rate. A higher pressure will increase the cooling rate. For example, a two-step process can be used wherein the inert gas pressure is increased during the initial cooling of the workload and then the gas pressure is reduced when a desired transformation temperature is reached. Such a two-step process simulates the behavior of ideal quenching medium by providing faster cooling at the beginning of the quenching step and slower cooling at a later stage. Thus, the vegetable oil quenchant would provide high initial quenching speed in the critical hardening range when the pressure of the inert gas is increased and a slower final quenching speed through the low temperature range would be realized by reducing the pressure of the inert gas.

It will be appreciated that the variation of vacuum level and inert gas pressure during the quenching step permits a wide variety of transformation scenarios to be achieved. Thus, depending on the alloy to be quenched and the desired properties and microstructure, the quenching process can be adapted to simulate such quenching techniques as martempering, hot oil quenching, and austempering. For example, to accomplish a martempering, hot oil quench, or austempering, the inert gas pressure would be increased in the higher temperature range at the beginning of the quenching cycle. The inert gas pressure would be lowered during the lower temperature portion of the quenching cycle.

In addition to the foregoing techniques, the invention also includes a combination of vacuum and pressure during the quenching step to vary the cooling rate. Thus, it is contemplated that the quenching step can be carried out with the quenching chamber initially under a positive pressure of inert gas, for example, up to about 10 bar to provide a faster cooling rate. At a later stage of the quenching step, the quenching chamber can be evacuated to a subatmospheric pressure, for example, down to about 5 torr, to provide a slower cooling rate.

After the quenching step is completed, the vegetable oil quenchant is removed from the quenching chamber. Preferably, the vegetable oil quenchant is pumped back into the reservoir. However, some residual oil will remain on the as-quenched workload and this residual oil must be removed before the workload can be transferred for further processing. Therefore, the process according to this invention includes a cleaning step after the quenching step.

During the cleaning step, a cleaning agent is introduced into the quenching chamber. At the start of the cleaning step, the quenching chamber is preferably pumped down to a vacuum below about 5 torr. When the desired vacuum is achieved, a solvent-type cleaning agent is injected into the quenching chamber as a mixture of liquid and vapor. Although a conventional hydrocarbon based solvent can be used, preferably the cleaning solvent is biodegradable type solvent such as soy methyl ester. A mixture of soy methyl ester and ethyl lactate is expected to provide good cleaning results because it does not leave a film on the surface of the metal parts. The solvent liquid and vapor adheres to the surface of the parts to be cleaned. During this cleaning step, condensation of the vapor on the metal parts will heat the parts being cleaned. To cool the parts and to rinse deposits after cleaning, the parts are sprayed or soaked with clean liquid solvent from the solvent supply tank. For that purpose, a separate set of spray nozzles is arranged inside the quenching chamber so that the liquid solvent can be applied to multiple sides of the work load.

When the cleaning, spraying, or soaking stage is completed, a vapor recovery process is preferably carried out. In this step, the quenching chamber is pumped down again to promote evaporation of the liquid solvent. The solvent vapor is evacuated from the quenching chamber by the vacuum pump to a heat exchanger, where it is condensed back to liquid form. From the condenser the liquid solvent is returned to the solvent supply tank. To remove any residual solvent, the quenching chamber is restored to atmospheric pressure by backfilling the quenching chamber with inert gas. The remaining solvent, which would be vaporized, is evacuated with a vacuum pump. The intake line of the vacuum pump is adapted with an activated carbon filter which adsorbs the solvent vapor to separate it from the inert gas.

In order to recycle the vegetable oil quenchant and the liquid cleaning agent, the oil and cleaning agent are preferably separated before they are returned to their respective reservoirs. Any known apparatus or system for oil separation can be used in connection with the quenching process and apparatus of the present invention.

Figure 5:
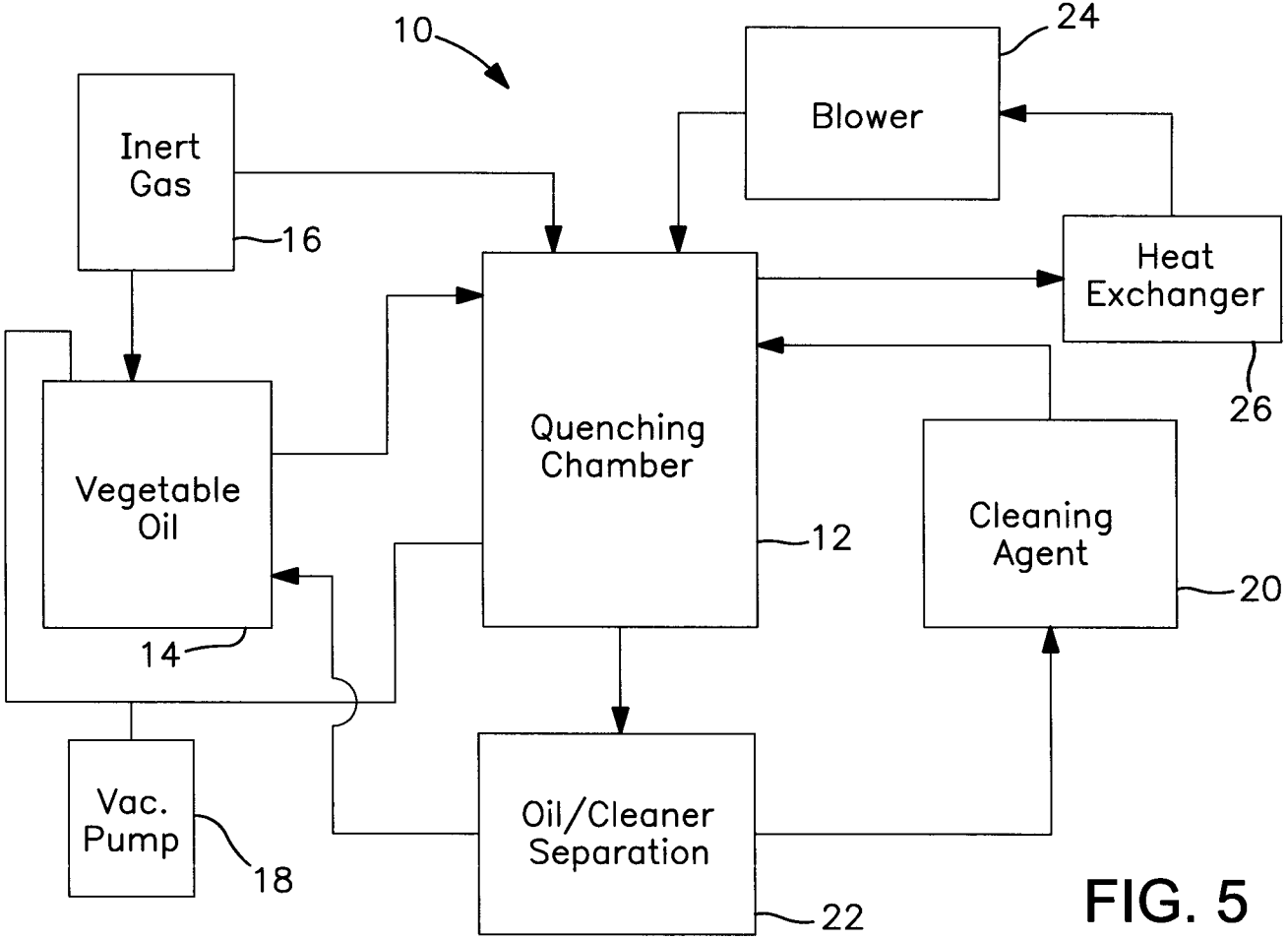
FIG. 5 is a functional block diagram of an apparatus for carrying out the quenching process according to the present invention.

Referring now to FIG. 5, there is shown a functional block diagram of an apparatus for carrying the process according to the present invention. The quenching apparatus 10 includes a quenching chamber 12. The quenching chamber 12 preferably includes a pressure vessel having one or more openings through which a workload can be transferred either into or out of the quenching chamber. A preferred embodiment of a quenching chamber is shown and described in copending application Ser. No. 13/723,368, filed Dec. 21, 2012, the entirety of which is incorporated herein by reference.

A reservoir or tank 14 for holding a volume of vegetable of quenchant is operatively connected to the quenching chamber 12. As described above, the quenching chamber has piping and nozzles that are constructed and arranged inside the quenching chamber to spray or flood the vegetable oil quenchant over a workload in the quenching chamber 12. A pump (not shown) is preferably provided for pumping the oil quenchant that collects in the bottom of the quenching chamber through the nozzles so that the vegetable oil quenchant can be recirculated during the quenching cycle. A source 16 of inert gas, preferably nitrogen gas, is connected to the reservoir 14 and to the quenching chamber 12 to provide a pressurizing gas when desired.

A vacuum pump 18 is connected to the quenching chamber 12 and the vegetable oil reservoir 14. The piping or other connections arranged between vacuum pump 18, the quenching chamber 12, and the vegetable oil reservoir 14 are adapted with suitable valving so that a vacuum can be drawn on the quenching chamber 12, the vegetable oil reservoir 14, or both.

A cleaning agent reservoir 20 has an outlet that is operatively connected to the quenching chamber 12 to provide a cleaning fluid to be applied to a workload when the quenching step has been completed. Preferably, the quenching chamber is adapted with piping and spray nozzles for applying the cleaning fluid to the workload.

The quenching apparatus preferably includes an oil/cleaner separator 22. The oil/cleaner separator 22 has an inlet that is connected to a corresponding outlet in the quenching chamber 12 so that the mixture of oil and cleaner that collects in the quenching chamber after a quenching cycle can be transferred to the oil/cleaner separator 22. The oil/cleaner separator 22 includes a skimmer that is constructed and arranged to skim the used oil from the oil/cleaner mixture so that the oil and the cleaning agent can be reused. The oil/cleaner separator 22 may be realized by a SUPARATOR® brand oil separation system sold by Aqueous Recovery Resources, Inc. of Bedford Hill, N.Y. The oil/cleaner separator 22 has a first outlet that is connected to an inlet of the oil reservoir 14 and a second outlet that is connected to an inlet of the cleaning agent reservoir 20.

The quenching apparatus 10 optionally includes a blower 24 having an exhaust outlet that is coupled to the quenching chamber 12 so that a cooling gas can be blown into the quenching chamber 12 to provide forced gas cooling of the workload instead of vegetable oil quenching. An outlet from the quenching chamber 12 is connected to an inlet of the blower 24 to provide a closed loop for the cooling gas. Preferably, a heat exchanger 26 is connected between the quenching chamber outlet and the blower inlet for extracting heat from the cooling gas.

In view of the foregoing description of a method and system for quenching a heated workload, some of the advantages of the disclosed process should now be apparent. The quenching process according to the present invention uses a vegetable oil as the primary quenching medium. The use of such oils is advantageous because of their biodegradability (up to 100%) and their increased flashpoint and boiling point. Also, the vegetable oil quenchants do not show a vapor phase and therefore, provide increased cooling at the initial higher temperature of the quenching step. The vegetable oil quenching provides a lower cooling rate at the later lower temperature of the quenching step when the main heat transfer mode is convection. The lower cooling rate provides more uniform cooling through the part which results in producing less part distortion. Although the vegetable oil quenchant used in the process according to the present invention can be subject to oxidative instability if the oil is in contact with air. This oxidation will modify the oil quenching performance and lead to a dark surface on the as-quenched metal part. However, the performance of the quenching process at subatmospheric pressure and preferably also under a blanket of inert gas, substantially completely overcomes that disadvantage. Moreover, the application of inert gas pressure at different stages of the quenching step can speed up or slow down the cooling rate so that the actual cooling characteristic can be tailored for the type of metal and the desired microstructure in the as-quenched condition.

The terms and expressions which have been employed are used as terms of description and not of limitation. There is no intention in the use of such terms and expressions of excluding any equivalents of the features or steps shown and described or portions thereof. It is recognized, therefore, that various modifications are possible within the scope and spirit of the invention. Accordingly, the invention incorporates variations that fall within the scope of the invention as described.

The invention claimed is:

1. A process for cooling a metal workload that has been heated to an elevated temperature comprising the steps of:

providing a metal workload that has been heated to an elevated temperature selected to cause the metal in said workload to transform to austenite;

placing the metal workload in a quenching chamber while the metal part is at the elevated temperature;

closing the quenching chamber; and then quenching the metal workload by performing the following steps:

flowing a vegetable oil quenchant over the metal workload, and providing a positive pressure of an inert gas in the quenching chamber as the vegetable oil is flowed over the metal workload;

wherein the vegetable oil flow rate and the positive pressure of the inert gas are selected to provide a cooling rate sufficient to transform the metal to a second metallurgical phase comprising martensite, bainite, pearlite, or a combination thereof within a preselected time period.

2. The process as set forth in claim 1 wherein the step of providing the inert gas in the quenching chamber comprises the steps of:

raising the pressure of the inert gas to a first positive pressure during an initial stage of the flowing step to provide a first cooling rate, and then lowering the pressure of the inert gas to a second positive pressure during a second stage of the flowing step to provide a second cooling rate that is lower than the first cooling rate.

3. The process as set forth in claim 1 comprising the step of heating the vegetable oil quenchant to a temperature of 20° C. to 200° C. before performing said flowing step.

4. The process as set forth in claim 3 wherein the heating step is performed in a second sealable chamber and the process comprises the step of pressurizing the second sealable chamber with an inert gas.

5. The process as set forth in claim 1 comprising the step of removing the vegetable oil quenchant from the metal part by performing the following steps after the quenching step:

draining the vegetable oil quenchant from the quenching chamber;

evacuating the quenching chamber to provide a subatmospheric pressure in the quenching chamber;

injecting a cleaning material into the quenching chamber as a mixture of liquid and vapor such that the cleaning material adheres to the surfaces of the metal workload and combines with vegetable oil remaining on the surfaces of the metal workload; and then spraying additional cleaning material in the form of a liquid onto multiple surfaces of the metal workload so as to rinse the surface of the metal part, whereby the combination of the vegetable oil and the cleaning material is removed from the metal workload as a solution of the vegetable oil and the liquid cleaning material.

6. The process as set forth in claim 5 comprising the steps of re-evacuating the chamber after said spraying step such that the solution of vegetable oil and cleaning material in the quenching chamber evaporates to form a vapor; and then removing the vapor from the quenching chamber.

7. The process as set forth in claim 1 wherein the positive pressure of the inert gas is held for a time sufficient for the metal to transform to the second metallurgical phase.

8. The process as set forth in claim 1 wherein the positive pressure of the inert gas is not more than 15 bar.

9. The process as set forth in claim 6 comprising the following steps after said removing step:

condensing the vapor removed from the quenching chamber to form a liquid solution again; and then separating the vegetable oil from the cleaning material in the liquid solution.

10. The process as set forth in claim 6 which comprises the following steps after said removing step:

backfilling the quenching chamber with an inert gas to provide an atmospheric pressure inside said quenching chamber such that any residual liquid solution in the quenching chamber forms a solvent vapor;

removing the solvent vapor and the inert gas from the quenching chamber; and then separating the solvent vapor from the inert gas.

11. The process as set forth in claim 1 further comprising the step of recirculating the vegetable oil quenchant in the quenching chamber during said quenching step.

* * * * *